US006077175A

United States Patent [19]

Fearnow

[11] Patent Number: 6,077,175

[45] Date of Patent: Jun. 20, 2000

[54] BREAKAWAY SAFETY BASE FOR BASEBALL AND SOFTBALL

[76] Inventor: David E. Fearnow, 4516 14th, Dorr, Mich. 49323

[21] Appl. No.: 09/200,932

[22] Filed: Nov. 30, 1998

[51] Int. Cl.[7] ..... A63B 67/00

[52] U.S. Cl. ..... 473/468; 473/499; 473/501

[58] Field of Search ..... 473/498–501, 473/445, 468

[56] References Cited

U.S. PATENT DOCUMENTS

| | | | |
|---|---|---|---|
| 3,181,863 | 5/1965 | Nellermoe . | |
| 3,508,747 | 4/1970 | Orsatti | 473/499 |
| 3,572,705 | 3/1971 | Wyble | 473/499 |
| 3,862,756 | 1/1975 | Selliken . | |
| 3,971,558 | 7/1976 | Gardetto . | |
| 4,266,768 | 5/1981 | Hall . | |
| 4,398,714 | 8/1983 | Fuller et al. . | |
| 4,448,414 | 5/1984 | Gutierrez . | |
| 4,542,901 | 9/1985 | Fatool et al. | 473/501 |
| 4,744,561 | 5/1988 | Hall . | |
| 5,000,448 | 3/1991 | Anderson et al. . | |
| 5,203,557 | 4/1993 | Studebaker et al. | 473/499 |
| 5,564,695 | 10/1996 | Christensen . | |

FOREIGN PATENT DOCUMENTS

| | | |
|---|---|---|
| 614881 | 2/1961 | Canada . |

*Primary Examiner*—Jeanette Chapman
*Assistant Examiner*—Mitra Aryanpour
*Attorney, Agent, or Firm*—Richard C. Litman

[57] ABSTRACT

A breakaway safety base for use in baseball, softball, and other athletic base running games generally comprises a plate of metal or other suitable material, which is permanently secured to the underside of the base. The plate has a periphery with a plurality of downwardly turned edges, which engage the underlying ground. Generally vertical force on the base, as by a fielder or runner stepping on the base, results in the edges engaging the underlying surface more firmly, thereby resisting lateral displacement of the base. However, generally horizontal force on the base, as by a runner sliding into the base, allows the base to be horizontally displaced. This horizontal displacement of the base precludes any serious injury to the sliding base runner. The present breakaway safety base does not require any permanent anchor or other mating component to be permanently set or driven into the surface, thereby allowing the present safety base to be used to define any desirable base paths in any suitable playing field. The anchor plate may have three or more downwardly turned edges, with the edges being at an angle of less than, equal to, or more than 90 degrees to the main body of the plate. Preferably, the edges and corners of the depending anchor edge portions are smoothly rounded, in order to preclude injury to a player in the event of contact with one of the edges of the anchor after the base has been upset.

11 Claims, 3 Drawing Sheets

BREAKAWAY SAFETY BASE FOR BASEBALL AND SOFTBALL

BACKGROUND OF THE INVENTION

1. Field of the Invention

The present invention relates generally to athletic games and sports, and more specifically to a breakaway safety base for baseball, softball, and related games using bases. The present invention comprises a plate with a plurality of downwardly turned edges, with the plate being permanently attached to the bottom of the base. The downwardly turned edges resist lateral movement of the base when substantially vertical pressure is placed thereon, as by a runner stepping on the base, but offer little horizontal resistance to displacement in the event that a runner slides into the base. The present safety plate and base provide greater safety for baseball and softball players, by virtually eliminating any chance of jamming a leg or ankle when sliding into a base.

2. Description of the Related Art

Baseball, softball, and similar athletic games have been known for sometime, where a base runner is to contact each of a series of bases sequentially and attempt to return to the starting point before being tagged or called out, in accordance with the rules of the game. One way a runner may be tagged out, is to come into contact with the ball while the runner is not in contact with the base, particularly at second and third bases in baseball and softball.

Accordingly, runners are customarily taught to slide into second and third bases when a play appears to be close, in order to make it more difficult for an opposing player to tag the runner before the runner reaches the base. This aspect of the game is one of the more difficult to learn, as the timing of the beginning of the slide is critical in terms of sliding to a stop before contacting the base so hard as to injure the runner. The point at which the slide must be initiated is quite variable, depending upon the speed of the runner, the type of slide performed, the characteristics of the base path, and perhaps other factors as well. The "pop-up" slide, where a runner slides into a base with sufficient energy as to immediately rise to a standing position in order to be ready for an immediate departure for the next base or home plate, is perhaps the most difficult maneuver in base running to learn to perform well. Also, perhaps more injuries to ankles and other lower extremities occur as a result of sliding attempts, particularly so-called "pop-up" slides, than as a result of any other aspect of base running, particularly in junior and youth leagues where such techniques have not been refined.

Another point which must be considered, is that various youth and junior league rules provide for different distances between bases. Permanently anchored bases spaced for one league or group, may not be suitable for another. This can, and has, resulted in the canceling of games and tournaments where the only field was equipped with bases spaced at some different distances than that required for the teams or leagues scheduled to use the field.

Accordingly, a need will be seen for a breakaway safety base for use in baseball, softball, and other games utilizing bases. The safety base must provide reasonably firm anchorage for the base when generally vertical pressure is applied thereto, as when a S runner steps on and rounds a base without sliding, but yet must also readily give way when a hard horizontal force is applied to the base, as when a runner slides hard into a base. The present safety base must also provide for temporary installation without requiring any other additional temporary or permanent anchoring or attachment means to the underlying surface, thereby permitting the present safety base to be used at virtually any ball field and to be temporarily placed to meet the base spacing requirements of virtually any baseball or softball league or association.

A discussion of the related art of which the present inventor is aware, and its differences and distinctions from the present invention, is provided below.

U.S. Pat. No. 3,181,863 issued on May 4, 1965 to Donald A. Nellermoe, titled "Indoor Baseball Bag," describes an outer bag or container into which a regulation base may be placed. The outer bag includes a lower surface with a cleated, rubberized material thereon. The Nellermoe bag is intended only for indoor use, and is not intended to move when force is applied thereto. The rubberized gripping surface is adequate for hard flooring in a gymnasium or the like, but is not suitable for outdoor use on a bare earth base path and would likely slip upon such a surface, unlike the present safety base and attachment plate.

U.S. Pat. No. 3,862,756 issued on Jan. 28, 1975 to Conrad J. Selliken, titled "Magnetically Attached Baseball Base," describes an outdoor base assembly having a permanently installed ground component which holds a plurality of magnets thereon. An upper plate is secured to the underside of the base, with the plate having a corresponding plurality of ferrous metal areas therein. The base is temporarily secured to the permanently installed ground component by means of the magnetic attraction developed between the magnets of the ground component and the ferrous metal inserts of the base attachment plate. The Selliken base assembly cannot be used at temporary playing sites, where the permanent installation of the lower component in the base paths would be unacceptable. In contrast, the present safety base and plate attachment comprise only a single assembly, with no additional components being permanently installed in the ground, as with the Selliken device.

U.S. Pat. No. 3,971,558 issued on Jul. 27, 1976 to Alfred D. Gardetto, titled "Base Marker For Baseball," describes a base or home plate having a receptacle for a removable plug, with the plug being anchored to the ground by a pair of spikes which penetrate the surface. The relatively deep penetration of the spikes of the Gardetto assembly, would not permit lateral displacement of the upper base portion if a base runner were to slide hard into the base, thus possibly injuring the base runner. In contrast, the downwardly turned edges of the underlying plate of the present safety base, do not penetrate the ground significantly and allow the base to be displaced when a horizontal force is applied thereto.

U.S. Pat. No. 4,266,768 issued on May 12, 1981 to Roger E. Hall, titled "Breakaway Safety Base," describes an upper breakaway base portion and a lower support portion, with the support portion being buried permanently in the ground. The upper base portion is secured to the permanently installed lower portion by mating hook and loop fastening material (i. e., Velcro, tm). Again, the use of a permanently buried component is unacceptable in many areas, thus precluding use of the Hall bases in those areas. The present breakaway safety base does not require any permanently installed and/or separate components to which the base secures, unlike the other devices of the prior art.

U.S. Pat. No. 4,398,714 issued on Aug. 16, 1983 to Charles C. Fuller et al., titled "Ball Base Construction And Anchor," describes another two component assembly, with a permanently installed lower plate having a spike which is driven into the ground. The bottom of the base includes a mating channel and end flange, enabling the channel to be slipped over the permanently installed lower plate.

However, Fuller et al. also provides an extension for their base, which extends outside the foul line (particularly for first base) to enhance safety by avoiding collisions between the fielder and base runner. This extension would not be suitable for second base (or for most play requiring regulation bases), and permits the base to be displaced in only a single direction. In contrast, the present safety base arrangement may be displaced equally well in any horizontal direction, due to a sliding or other horizontal impact.

U.S. Pat. No. 4,448,414 issued on May 15, 1984 to Pete Gutierrez, titled "Baseball Base," describes an assembly having a permanently mounted ground anchor and removable upper base portion. The shape of the base engagement portion of the anchor is somewhat like a dovetail fitting, with the overlying base having a mating fit. The positive engagement of the two components precludes dislodging of the overlying base due to horizontal contact, unlike the present safety base invention. The fact that the base would have to be removed from the underlying attachment by positive prying or other force, and the requirement for a permanently installed, immovable attachment for the base, result in an assembly unlike the present safety base invention.

U.S. Pat. No. 4,744,561 issued on May 17, 1988 to Roger E. Hall, titled "Safety Base With Anchor," describes an assembly having a permanently installed anchor component which is buried deeply into the ground, and an overlying detachable base portion. Hall is also concerned about possible injury to a player sliding into an immovable base, as evidenced by his earlier '768 U.S. Patent. However, in both cases Hall has included a separate, permanently anchored portion to which the overlying base is removably attached. This configuration rules out its use in many playing environments, where the permanent installation of base anchors would not be permitted. In contrast, the anchor for the present breakaway base is permanently and immovably affixed to the underside of the base itself, with both the base and anchor plate providing relatively little resistance to a horizontal impact.

U.S. Pat. No. 5,000,448 issued on Mar. 19, 1991 to Gene J. Anderson, titled "Baseball Base," describes a multiple component base anchoring system comprising one or more strips of hook and loop fastening material which are staked to the ground at the spot where the base is to be placed. The underside of the base includes mating hook and loop material secured thereto. The result is somewhat like the assembly of the '768 U.S. Patent to Hall, discussed further above. No unitary, permanent assembly of anchor components with the base is provided by Anderson, as provided by the present breakaway safety base invention.

U.S. Pat. No. 5,564,695 issued on Oct. 15, 1996 to Arthur E. Christensen, titled "Break-Away Base," describes an assembly having two separable components. The first component is formed of sheet metal, and includes downwardly and outwardly extending edges. This component is buried in the ground with its upper surface substantially level with the ground, and a spike is used to anchor the device more securely. The base component includes a magnetic plate therebeneath, with the magnetic plate serving to secure the base to the underlying anchor portion. This system is unsuitable for use in many playing fields, due to the necessity of digging a depression for placement of the permanently anchored portion of the assembly. Also, Christensen requires that the edges of the anchor portion be bent outwardly, to provide a ramp effect in the event that a runner digs into the ground as he or she reaches the base, thus causing the portion of the runner's body to slide up and over the sloped side of the anchor portion.

Finally, Canadian Patent Publication No. 614,881 issued on Feb. 21, 1961 to Herbert W. Henry, titled "Base Sack Anchorage Means," describes a permanently anchored component which is imbedded in the ground, with a base component which is movably secured to the anchored component. The lower, permanently anchored component includes a spring loaded upper plate, which may be moved laterally to the limits of its spring attachment to the immovable anchored component. The base attaches to the spring loaded upper plate. The resulting assembly allows some limited movement of the base if the base is struck by a hard horizontal force (e.g., runner sliding into the base). However, the requirement for permanently anchoring one component of the assembly in the ground, renders the Henry assembly unsuitable for use on playing fields where the bases may only be temporarily placed. The present safety base invention includes both the underlying anchor portion as well as the overlying base portion as a single assembly, with no digging or other penetration of the ground being required to any appreciable extent.

None of the above inventions and patents, taken either singly or in combination, is seen to describe the instant invention as claimed.

SUMMARY OF THE INVENTION

The present invention comprises a breakaway safety base for base running games, such as baseball and softball. The present safety base comprises a single, unitary assembly, with the underlying anchor portion and overlying base portion comprising a permanent assembly. The assembly is placed in the desired location on the playing field, without any requirement that the surface of the field be dug into for installation of any of the components of the present safety base. The lower anchor portion essentially comprises a plate formed of metal or other suitable material, with the plate having a plurality of downwardly bent edges. These edges engage the underlying surface to a slight extent, to anchor the base unless the base is struck by a substantial horizontal impact as by a sliding base runner. Yet, generally vertical forces on the base, as by a runner or fielder stepping on the base, tend to drive the edges of the anchor portion more firmly into the underlying surface, precluding slippage of the base under such circumstances.

The anchor portion may have any practicable number of edges. Preferably, the edges are bent downwardly normal to the plane of the plate, but may be bent downwardly to form angles greater or less than 90 degrees, if so desired. The edges of the anchor plate are smoothly rounded, in order to preclude injury to a player who might encounter one of the edges if the base is upset during a slide. Other modifications (lightening holes, sizes larger or smaller than the overlying base, etc.) may be provided if so desired.

Accordingly, it is a principal object of the invention to provide an improved breakaway safety base for baseball, softball, and other related athletic games incorporating one or more bases.

It is another object of the invention to provide an improved safety base comprising a generally conventional overlying base, with underlying anchor means permanently secured thereto.

It is a further object of the invention to provide an improved safety base which does not require digging or other invasive procedure for anchoring the base to the underlying ground.

An additional object of the invention is to provide an improved safety base which anchor portion resists lateral movement when a generally vertical force is applied thereto, but which slides freely when a generally horizontal force is applied thereto.

Still another object of the invention is to provide an improved safety base which anchor portion generally comprises a plate secured to the underside of the base, with the plate having a plurality of downwardly turned edges about the periphery thereof for engaging the underlying ground surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
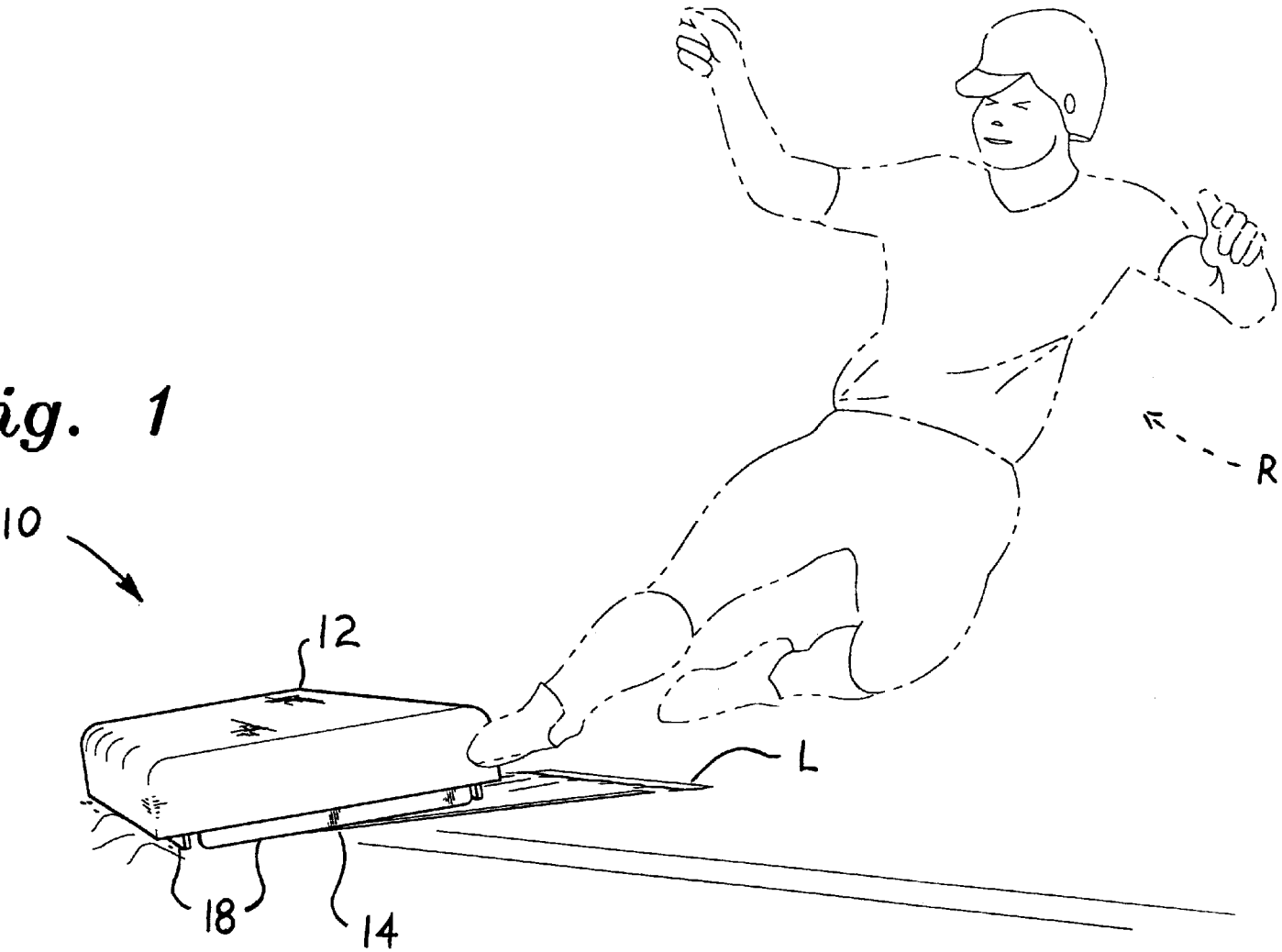
FIG. 1 is an environmental perspective view of a base runner sliding into the present safety base, showing its lateral dislodging from the underlying surface due to the generally horizontal force developed by the sliding runner.

The present invention comprises a breakaway safety base for the protection of players, particularly base runners, during play of athletic base running games such as baseball and softball, etc. FIG. 1 illustrates the operation of the present safety base assembly 10 as a base runner R slides generally horizontally into the assembly 10, imparting a horizontal force component which allows the base assembly 10 to be horizontally dislodged from its originally seated location L in the earth of the base path.

Figure 2:
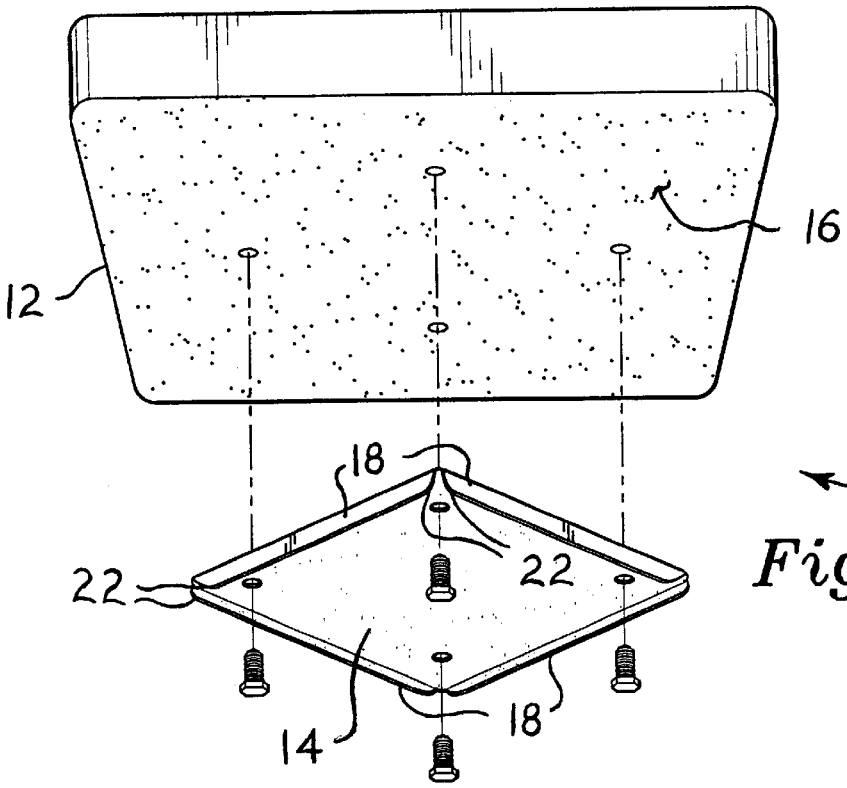
FIG. 2 is an exploded perspective view of a base and the anchor plate of the present invention, showing the permanent installation means for securing the plate to the underside of the base.

The base assembly 10 comprises a standard base 12, with a rigid anchor plate 14 permanently secured to the flat underside 16 thereof (e.g, conventional bolts, screws, etc., or other suitable means), as shown in FIG. 2. (It should be noted that while such mechanical fasteners may be removed with suitable tools and sufficient time, that the plate 14 is permanently installed to the underside 16 of the base 12 in the sense that it is not intended to be removed routinely, unless replacement of the base 12 or other component repair or replacement is required.)

The anchor plate 14 essentially comprises a rigid sheet of material having a flat, planar center portion and a polygonal periphery with a plurality of downwardly turned edges 18 extending therefrom. Preferably, the plate 14 and other embodiments thereof are formed of a relatively thick and durable gauge of steel or other suitable material, in order to provide sufficient resistance to bending for the downwardly turned flanges or edges 18. Ten to twelve gauge steel plate has been found to work well.

Figure 3:
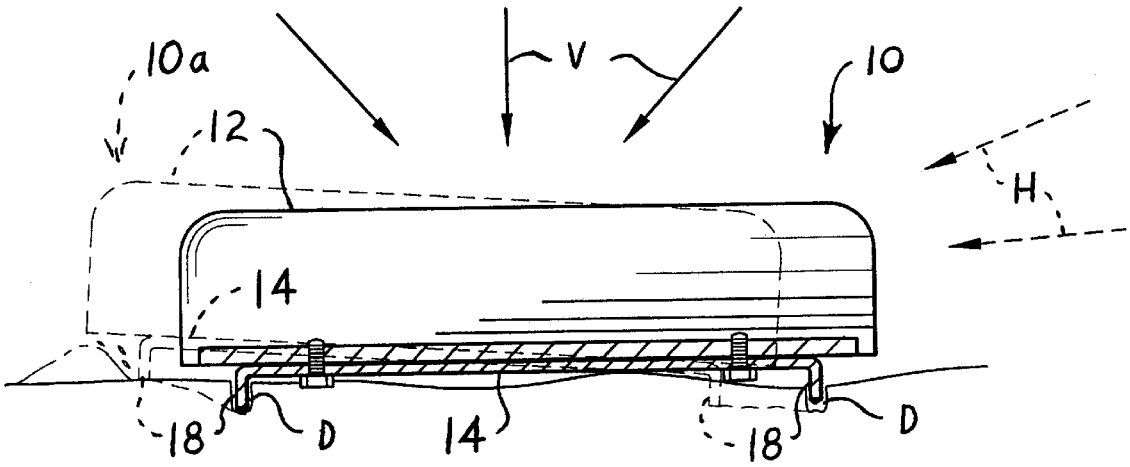
FIG. 3 is an elevation view in section of the base and anchor plate of the present invention, generally showing the forces required to dislodge the assembly from the underlying surface.

The downwardly turned edges 18 of the plate 14 tend to "dig in" slightly into the underlying ground surface, particularly a surface comprising firm bare earth, as in the case of the typical base path of a baseball or softball field. The edges 18 will work into the earth slightly and form shallow channels or depressions D, as shown in FIG. 3 of the drawings. When a generally vertical force V (shown by the solid arrows and stationary base and plate assembly 10 of FIG. 3) is imparted to the base 12 and safety plate 14, the force is transferred generally downwardly into the depression D formed by the edges 18. The walls of these depressions D resist any relatively slight horizontal force component developed by generally vertical downward forces V, even if there is some slight horizontal component to the generally vertical forces V.

However, in the event that generally or substantially horizontal forces H (indicated by the broken line arrows of FIG. 3) are applied to the base and plate assembly 10, the lack of vertical pressure on the assembly 10 along with the substantial horizontal force component, forces the downwardly turned edges 18 to "plow" somewhat through the earth depressions D, allowing the base and plate assembly 10 to be displaced laterally, as to a new position 10*a*, shown in broken lines in FIG. 3. The resistance of the earth against the edges 18 provides some resistance to lateral displacement of the base and plate assembly to preclude substantial movement thereof, but still provides sufficient "give" to avoid imparting sufficient force to the base runner to cause injury thereto.

Figure 4:
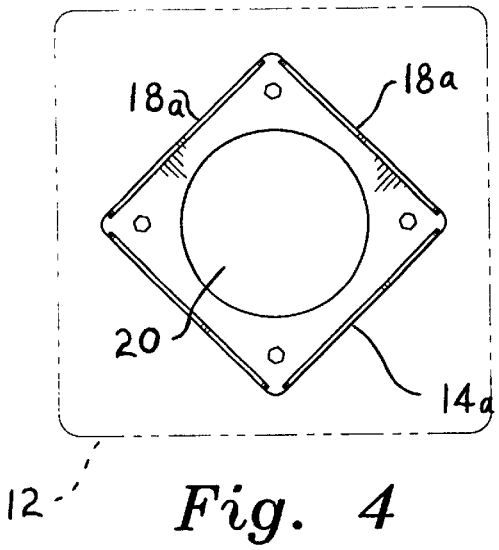
FIG. 4 is a bottom plan view of an alternative embodiment of the present anchor plate, showing a lightening hole formed therethrough.

The plate 14 of FIGS. 1 through 3 (and plate 14*a* of FIG. 4) are quadrangular, or more specifically essentially square, in shape, having four depending edges 18 (or 18*a*, in FIG. 4). Provision of a solid, continuous central area serves to provide additional mass, for resistance to inadvertent displacement due to relatively light lateral forces. However, other configurations may be provided if desired, such as the plate 14*a* of FIG. 4 which incorporates a lightening hole 20 in its center in order to reduce the total weight of the base 12 and safety plate 14*a* assembly.

Figure 5:
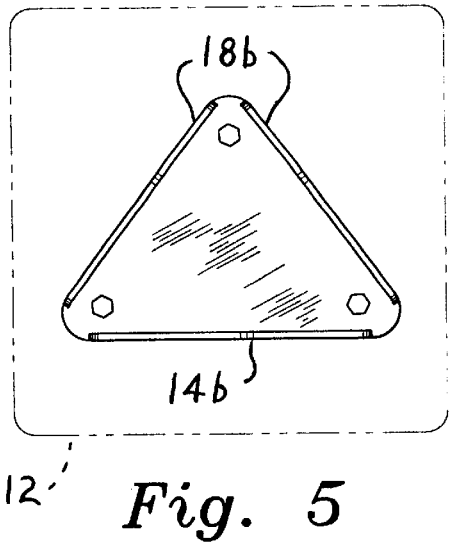
FIG. 5 is a bottom plan view of another alternative embodiment, showing an alternative shape for the anchor plate.
Figure 6:
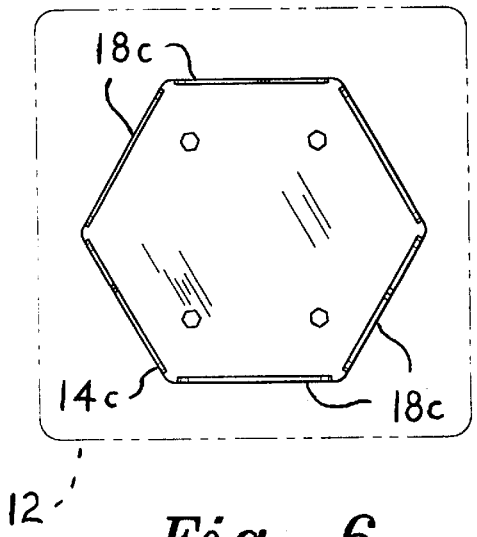
FIG. 6 is a bottom plan view of yet another alternative embodiment, showing another alternative shape.

FIGS. 5 and 6 illustrate additional polygonal shapes which might be used to form the safety plate base attachment of the present invention. It should be understood that the polygonal shapes illustrated in each of the drawing Figures of the present invention are exemplary, and that other regular or irregular polygonal or curved shapes may be used, if so desired. The important point is that the periphery of the plate have downwardly extending edges therefrom, to engage the base path surface beneath the base to perform the desired function described above.

In FIG. 5, a triangular plate 14*b* is illustrated, having three depending edges 18*b*. The triangular plate 14*b* may be an equilateral or irregular triangle, as desired. In FIG. 6, a hexagonal plate 14*c* is shown, with six depending edges 18*c*. Again, the shape may be regular or irregular, as desired. However, a substantially square shape is preferred in order to attach squarely to the bottom of the base 10, as shown in FIGS. 1 and 3 of the drawings.

It will be seen that the square or quadrangular plate 14 of FIGS. 1 through 3, and 14*a* of FIG. 4, may be secured to the bottom surface of the base 12 in a non-square relationship if so desired, e.g, with the edges 18 (or 18*a*) of the plate 14 (or 14*a*) disposed diagonally relative to the edges of the base 12, as shown in FIGS. 2 and 4. However, installation of the plate 14 (or 14*a*) with the edges 18 (or 18*a*) parallel to the sides of the base 12, as shown in FIGS. 1 and 3, allows the plate 14, 14*a* to be made larger, with the edges 18, 18*a* extending essentially the entire length of the sides of the base 12 in order to grip the underlying surface better.

While the plates 14 through 14*c* of FIGS. 1 through 6 are shown to be somewhat smaller than the attached base 12, it will be seen that the present breakaway safety plate may be somewhat larger than the base to which it is attached, if so desired. Such a configuration is shown by the plate 14*d* of FIG. 7, with its periphery defined by the edges 18*d* extending somewhat past the periphery of the base 12, shown in broken lines.

Figure 7:
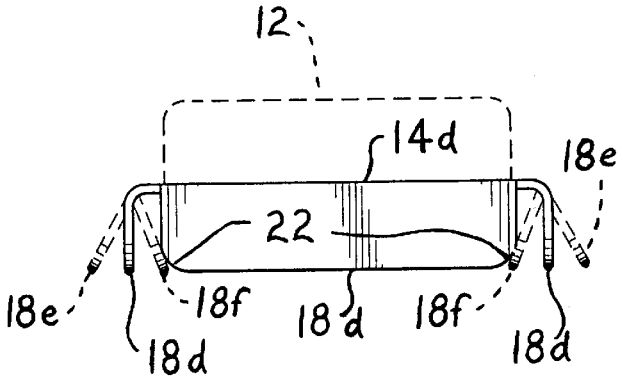
FIG. 7 is a side elevation view of still another alternative embodiment of the anchor plate, showing a plate having a size larger than the overlying attached base.

FIG. 7 also discloses the various options for the depending edges of the safety plate of the present invention. In FIGS. 1 through 6, the depending edges 18 through 18*c* are substantially normal to the center portion of the plate, being bent downwardly to about 90 degrees. However, the edges may be alternatively bent to form an obtuse included angle with the center portion of the plate, as shown by the edges 18*e* of FIG. 7, or to form an acute included angle to the plate center portion, as shown by the edges 18*f*.

The object of the present breakaway safety base and plate assembly in its various embodiments, is to provide safer play for players (particularly base runners) who have occasion to slide into a base, as noted further above. It will be seen that on occasion the present safety base and plate assembly may be upset if hit by a particularly energetic slide, which may expose the edges of the safety plate. Accordingly, the corners of the edges, and the edges themselves, are preferably smoothly rounded in order to reduce the chance of cuts or other injuries therefrom, as shown clearly by the corners 22 of the plates 14 and 14*d* respectively of FIGS. 2 and 7. The relatively thick material preferably used in the construction of the present safety plates, in combination with the smoothly rounded edges and corners 22, greatly reduces the potential of injury to a player who might encounter one of the edges in the event the base and plate assembly is upset during play.

In summary, the present breakaway safety base and plate assembly serves to provide a much safer means of securing a base in place during normal play in baseball, softball, and other base running athletic games. However, the present safety base assembly also protects base runners who have occasion to slide hard into the base, due to the resulting displacement of the assembly due to horizontal forces encountered by a sliding base runner. The present safety base assembly may be used in virtually any suitable playing field, without need to drive stakes or other anchors or to dig up the base paths for installation of the base.

The present safety base and plate assembly thus provides a significant advantage for youth leagues and other organizations which may use nonstandard base path dimensions, as the present base and plate assemblies may be placed anywhere desired on the playing field, with the downwardly turned edges of the plates engaging the underlying surface to seat the base securely during normal play.

The safety plate is preferably formed of durable material which will withstand the rigors of athletic play. It is likely that the fabric covering and fill material of the base to which the present safety plate is attached, will wear out well before the underlying plate. While the plate is essentially permanently attached to the overlying base, it will be seen that the fasteners used for securing the base and plate to one another, may be removed for transferring the plate to a new base, if necessary. The plate will then likely last for the life of the new base as well. Thus, the present breakaway safety plate provides an extremely economical means of protecting younger players and broadening the areas in which they may play as well, and will prove to be a most useful accessory for many youth and junior baseball and softball leagues and organizations, as well as others who have occasion to play such athletic games.

It is to be understood that the present invention is not limited to the embodiments described above, but encompasses any and all embodiments within the scope of the following claims.

I claim:

1. A breakaway safety base assembly for use in athletic base running games, said assembly consisting of:

a base used in sport games, said base having a flat underside;

a rigid plate of material having a flat, planar center portion and a surrounding periphery; and means for permanently securing said plate to said underside of said base;

said periphery having at least four downwardly turned edges extending therefrom for engaging the underlying ground surface;

wherein each of said at least four downwardly turned edges of said periphery resisting substantial displacement of said plate when a generally downward force is applied to said base, and permitting displacement of said plate when a generally horizontal force is applied to said base.

2. The safety base according to claim 1, wherein said periphery of said plate has a shape selected from the polygonal shapes consisting of quadrangular, and hexagonal polygons, with said plate further including a plurality of said downwardly turned edges respectively corresponding to the selected one of said polygonal shapes.

3. The safety base according to claim 1, wherein said downwardly bent edges of said plate are substantially normal to said center portion of said plate.

4. The safety base according to claim 1, wherein said downwardly bent edges of said plate form an obtuse included angle to said center portion of said plate.

5. The safety base according to claim 1, wherein said downwardly bent edges of said plate form an acute included angle to said center portion of said plate.

6. The safety base according to claim 1, wherein said edges of said plate include corners, with each of said edges and said corners being smoothly rounded for precluding injury due to contact therewith.

7. The safety base according to claim 1, wherein said plate is formed of metal having a thickness from about ten gauge to twelve gauge.

8. The safety base according to claim 1, wherein said plate is smaller than said base.

9. The safety device according to claim 1, wherein said plate is larger than said base.

10. The safety device according to claim 1, wherein said plate and said base are both substantially square, and said plate is squarely mounted to said base.

11. The safety device according to claim 1, wherein said plate and said base are both substantially square, and said plate is diagonally mounted to said base.

* * * * *